US006735800B1

(12) United States Patent
Salvatini et al.

(10) Patent No.: US 6,735,800 B1
(45) Date of Patent: May 18, 2004

(54) DISPOSABLE MATTRESS PORTION

(75) Inventors: Ben Salvatini, Summerville, SC (US); John Brenner, Goose Creek, SC (US); Kerry J. Mensching, Mount Pleasant, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/604,208

(22) Filed: Jun. 27, 2000

Related U.S. Application Data

(63) Continuation-in-part of application No. 09/551,266, filed on Apr. 18, 2000, now Pat. No. 6,493,888.

(51) Int. Cl.[7] ..... A47C 27/10
(52) U.S. Cl. ..... 5/713; 5/710
(58) Field of Search ..... 5/713, 706, 710, 5/499, 655.3, 644

(56) References Cited

U.S. PATENT DOCUMENTS

| | | | | |
|---|---|---|---|---|
| 1,730,752 A | | 10/1929 | Withers | |
| 1,772,310 A | | 8/1930 | Hart | |
| 2,604,641 A | | 7/1952 | Reed | |
| 2,757,389 A | | 8/1956 | King | |
| 3,083,379 A | | 4/1963 | Marinsky | |
| 3,421,163 A | | 1/1969 | Stoughton | |
| 3,477,071 A | | 11/1969 | Emerson | |
| 3,485,240 A | | 12/1969 | Fountain | |
| 3,513,489 A | | 5/1970 | Miller et al. | |
| 3,605,145 A | * | 9/1971 | Graebe | 5/706 |
| 3,717,885 A | | 2/1973 | De Mare | |
| 3,772,717 A | | 11/1973 | Yuen et al. | |
| 3,775,781 A | | 12/1973 | Bruno et al. | |
| 4,042,988 A | | 8/1977 | Holliday | |
| 4,066,072 A | | 1/1978 | Cummins | |
| 4,151,618 A | | 5/1979 | Carpenter | |
| 4,267,611 A | | 5/1981 | Agulnick | |
| 4,336,621 A | | 6/1982 | Schwartz et al. | |
| 4,454,615 A | * | 6/1984 | Whitney | 5/691 |
| 4,486,909 A | | 12/1984 | McKneelan | |
| 4,525,885 A | | 7/1985 | Hunt et al. | |
| 4,672,702 A | | 6/1987 | Isham | |
| 4,682,378 A | | 7/1987 | Savenije | |
| 4,697,290 A | | 10/1987 | Alklind et al. | |
| 4,706,313 A | | 11/1987 | Murphy | |
| 4,730,604 A | | 3/1988 | Boggs | |
| 4,905,332 A | | 3/1990 | Wang | |
| 4,924,541 A | * | 5/1990 | Inagaki | 5/652.1 |
| 4,934,002 A | | 6/1990 | Watanabe | |
| 4,944,060 A | | 7/1990 | Peery et al. | |
| 4,947,500 A | | 8/1990 | Seiler | |
| 4,949,412 A | | 8/1990 | Goode | |

(List continued on next page.)

FOREIGN PATENT DOCUMENTS

| | | |
|---|---|---|
| BE | 885296 | 1/1981 |
| DE | 3612362 A1 | 10/1987 |
| EP | 0 491 145 A | 6/1992 |
| EP | 0 986 979 A1 | 3/2000 |
| FR | 2 641 455 | 7/1990 |
| FR | 2 656 795 | 7/1991 |
| GB | 1 386 249 | 3/1975 |
| WO | WO 86/02815 | 5/1986 |
| WO | WO 96/33641 | 10/1986 |
| WO | WO 87/04934 | 8/1987 |
| WO | WO 98/20828 | 5/1998 |
| WO | WO 98/36665 | 8/1998 |
| WO | WO 99/49761 | 10/1999 |
| WO | WO 99/56591 | 11/1999 |

*Primary Examiner*—Teri Pham Luu
*Assistant Examiner*—Fredrick Conley
(74) *Attorney, Agent, or Firm*—Bose McKinney & Evans LLP

(57) ABSTRACT

A mattress including a cover having a side wall defining an interior region of the cover, a first cushion integral with the side wall of the cover, and a second cushion positioned in the interior region of the cover.

15 Claims, 3 Drawing Sheets

U.S. PATENT DOCUMENTS 4,977,629 A 12/1990 Jones
5,027,454 A 7/1991 Peng
5,063,912 A 11/1991 Hughes
5,067,189 A 11/1991 Weedling et al.
5,081,722 A 1/1992 Yu
5,081,728 A 1/1992 Skinner
5,088,747 A 2/1992 Morrison et al.
5,092,007 A 3/1992 Hasty
5,111,544 A 5/1992 Graebe
5,142,720 A 9/1992 Kelso et al.
5,182,826 A 2/1993 Thomas et al.
5,191,664 A 3/1993 Wyatt
5,216,769 A 6/1993 Eakin
5,269,030 A 12/1993 Pahno et al.
5,301,457 A 4/1994 Seely
5,305,483 A 4/1994 Watkins
5,313,679 A 5/1994 Yamaguchi
5,317,767 A 6/1994 Hargest et al.
5,325,551 A * 7/1994 Tappel et al. ..... 5/709
5,333,336 A * 8/1994 Langsam ..... 5/654
5,375,273 A 12/1994 Bodine, Jr. et al.
5,400,448 A * 3/1995 Zwickey ..... 5/691
5,483,711 A 1/1996 Hargest et al.
5,513,402 A 5/1996 Schwartz
5,553,339 A * 9/1996 Thomas ..... 5/413 AM
5,634,225 A 6/1997 Miller, Sr. et al.
5,675,852 A 10/1997 Watkins
5,699,569 A 12/1997 Schwarz-Zöhrer
5,729,853 A 3/1998 Thompson
5,731,062 A 3/1998 Kim et al.
5,787,534 A 8/1998 Hargest et al.
5,794,289 A 8/1998 Wortman et al.
5,865,771 A 2/1999 Shuto et al.
5,887,304 A 3/1999 Von der Heyde
5,904,172 A 5/1999 Gifft et al.
5,926,883 A 7/1999 Rechin et al.
5,966,762 A 10/1999 Wu
6,014,783 A 1/2000 Collier et al.
6,052,853 A 4/2000 Schmid
6,055,690 A 5/2000 Koenig
6,079,070 A * 6/2000 Flick ..... 5/715
6,131,216 A 10/2000 Pine
6,131,219 A * 10/2000 Roberts ..... 5/644
6,145,142 A 11/2000 Rechin et al.
6,336,237 B1 1/2002 Schmid
6,370,716 B1 4/2002 Wilkinson
6,370,718 B1 4/2002 Schmid

* cited by examiner

DISPOSABLE MATTRESS PORTION

RELATED APPLICATIONS

This application is a continuation-in-part of U.S. application Ser. No. 09/551,266, filed Apr. 18, 2000, issued as U.S. Pat. No. 6,493,888.

BACKGROUND AND SUMMARY OF THE INVENTION

The present invention relates to patient supports. More particularly, the present invention relates to mattresses for patient supports configured to support a patient positioned on the mattress.

Patient supports are often used during treatment or recovery of a patient in a care facility. Patient supports typically includes a bed frame having a deck and a mattress positioned on the deck to support the patient.

According to the present invention, a mattress is provided for use on a deck of a bed. The mattress includes a cover, a first cushion, and a second cushion. The cover includes a side wall defining an interior region of the cover. The first cushion is integral with the side wall of the cover and the second cushion is positioned in the interior region of the cover.

According to preferred embodiments of the present invention, the mattress further includes an inner wall and the cover includes an outer wall coupled to the inner wall to define the first cushion which is inflatable. The outer wall of the cover includes an opening configured to receive the second cushion to permit a care giver to insert the second cushion through the opening into the interior region of the cover. The mattress further includes a fastener that extends through the opening to couple the second cushion to the deck of the bed. The second cushion includes a layer of three dimensional engineered material.

Additional features of the disclosure will become apparent to those skilled in the art upon consideration of the following detailed description when taken in conjunction with the accompanying drawings.

BRIEF DESCRIPTION OF THE DRAWINGS

The detailed description particularly refers to the accompanying figures in which.

DETAILED DESCRIPTION OF THE DRAWINGS

Figure 1:
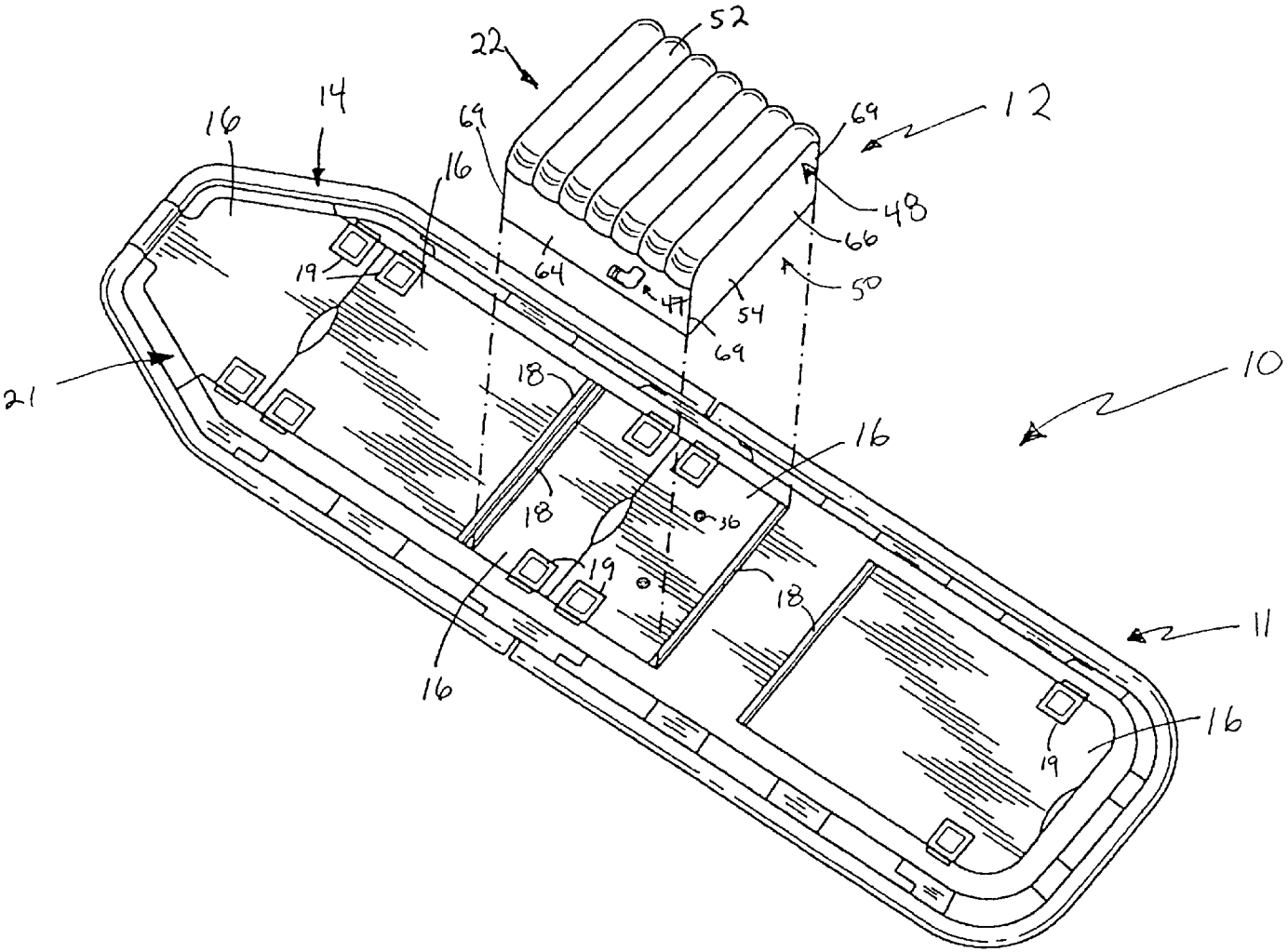
FIG. 1 is a perspective view of a stretcher for use with a proning bed having a perimeter frame, a multi-panel deck, and a disposable mattress section.

A portable bed or stretcher 10 is shown in FIG. 1. Stretcher 10 includes a mattress support section 11 and a disposable mattress section 12 positioned over mattress support section 11 so that mattress section 12 can be coupled to mattress support section 11 of stretcher 10 by a care provider. After use, a disposable portion of mattress section 12 is discarded and other portion of mattress section 12 is reused with new disposable portion.

Stretcher 10 may be coupled to a proning bed (not shown). The proning bed rotates the stretcher 10 and the patient positioned thereon so that the patient is moved between upwardly and downwardly facing positions or any position therebetween. Mattress support section 11 includes a perimeter frame 14 and a series of panels 16 pivotally coupled to perimeter frame 14 by a series of hinges 18 and latches 19 to define a deck 21. When the patient is in the downwardly facing position, one or more of panels 16 may then be opened by moving the respective latches 19 and by moving panels 16 about their respective hinges. Opening the panels 16 permits access to the patient's back without removing stretcher 10 from its position on top of the patient. A description of a suitable proning bed is provided in PCT Application No. PCT/US99/14525, the disclosure of which is expressly incorporated by reference herein. Mattress section 12 may also be used with other bed configurations.

Figure 2:
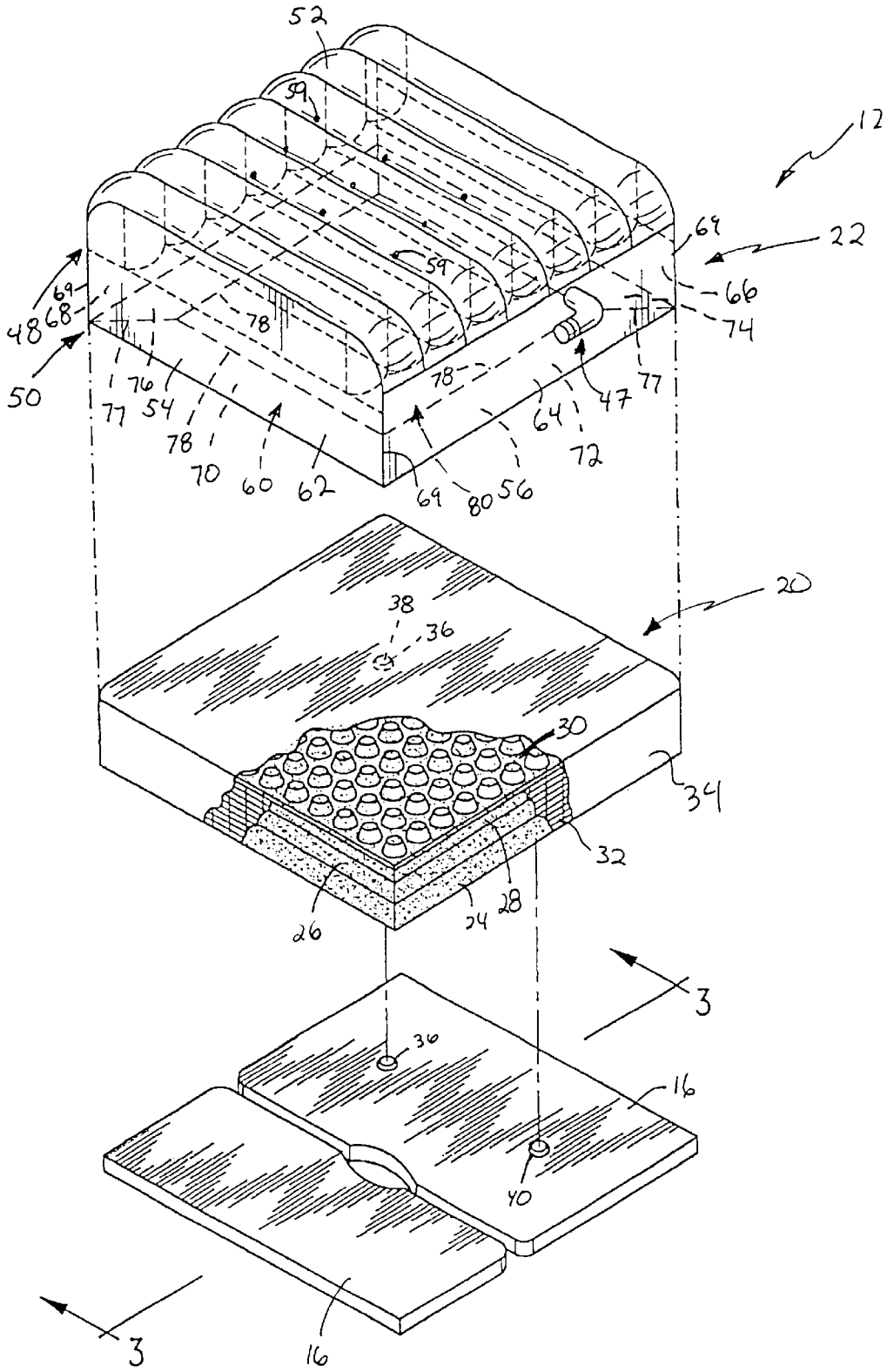
FIG. 2 is an exploded view of the mattress section of FIG. 1 showing the mattress section including a lower cushion positioned over two panels of the deck and an upper mattress portion positioned over the lower cushion.
Figure 3:
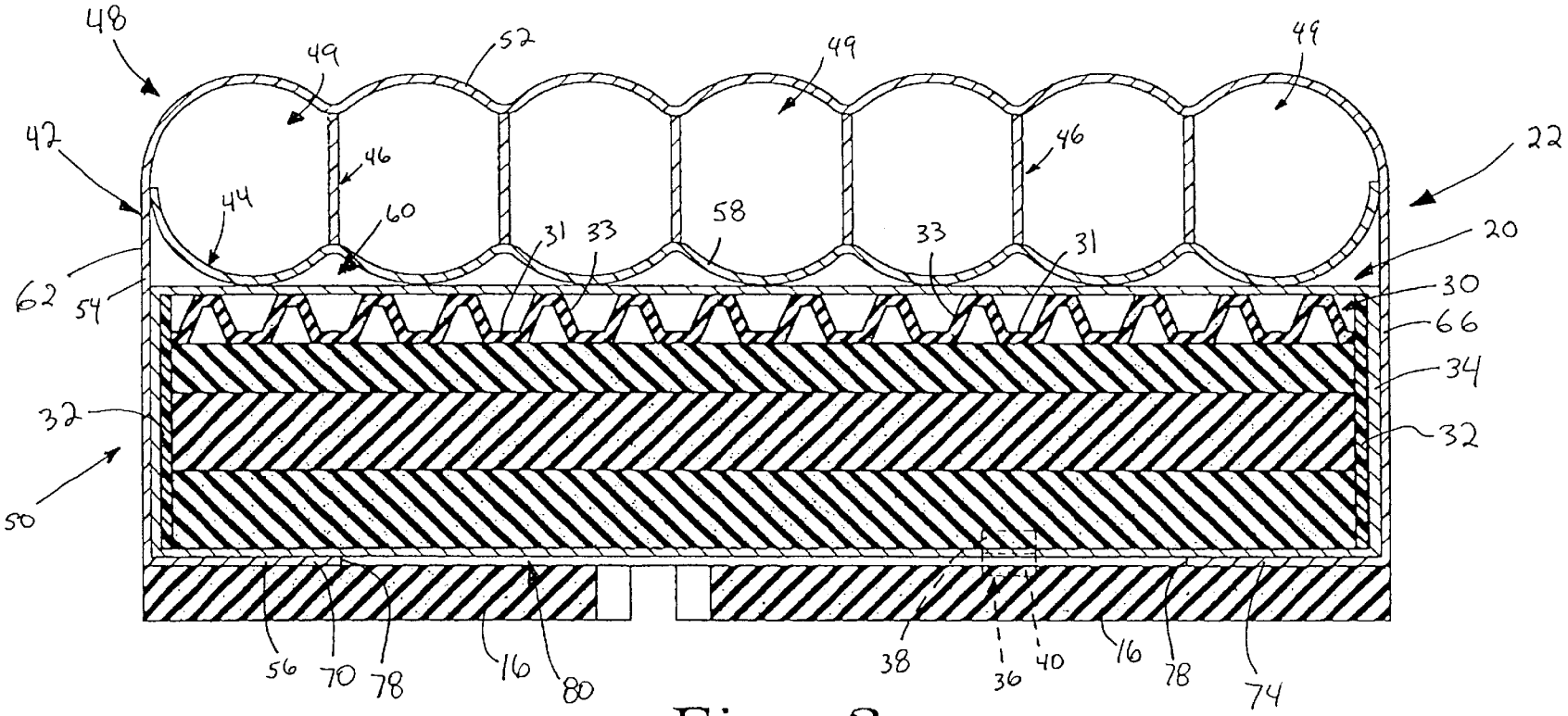
FIG. 3 is a cross-sectional view taken along lines 3—3 of FIG. 2 showing the lower cushion positioned within the upper mattress portion.

Stretcher 10 further includes additional mattress sections (not shown) similar to mattress section 12 so that stretcher 10 provides a resilient support surface for a person positioned on stretcher 10. As shown in FIG. 2, mattress section 12 includes a lower reusable mattress portion or cushion 20 and an upper disposable mattress portion 22 that is positioned over lower cushion 20. As shown in FIG. 3, upper mattress portion 22 covers around lower cushion 20 so that upper mattress section 22 covers lower cushion 20. According to the presently preferred embodiment of the present disclosure, upper mattress portion 22 is inflatable. According to alternative embodiments of the disclosure, the upper mattress portion includes foam or another resilient material.

Before mattress section 12 is coupled to panel 16, upper mattress portion 22 is wrapped around lower cushion 20. Mattress section 12 is then coupled to panel 16 to provide support for a patient positioned therein. After the patient is removed from stretcher 10, mattress section 12 is removed from panel 16 and lower cushion 20 is removed from within upper mattress portion 22. Upper mattress portion 22 is then disposed. However, lower cushion 20 is retained and cleaned and a substantially identical upper mattress portion 22 is positioned over lower cushion 20 so that mattress section 12 can be used for the next patient.

To position mattress section 12 on panels 16, a care provider first positions lower cushion 20 within upper mattress portion 22. After lower cushion 20 is securely positioned in upper mattress portion 22, a pair of fasteners 36 coupled to both lower cushion 20 and panel 16 are snapped together. Because lower cushion 20 is now secured to panel 16 and upper mattress portion 22 is wrapped around lower cushion 20, upper mattress portion 22 is secured to mattress section support 11.

As shown in FIGS. 2–3, lower cushion 20 includes a bottom layer of foam 24, an intermediate layer of foam 26, and a top layer of foam 28 positioned on top of intermediate layer of foam 26. The stiffness or ILD of layers 24, 26, 28 increases from top to bottom so that top layer 28 is the softest layer of foam and bottom layer of foam 24 is the stiffest layer of foam. Thus, lower cushion 20 has a stiffness gradient that increases with its depth.

Lower cushion 20 further includes a layer of three-dimensional engineered material 30 positioned on top of top layer of foam 28. Layer of engineered material 30 is made of a fiber network formed to include a base 31 and a plurality of resilient hollow projections 33 shaped as truncated cones as shown, for example, in FIG. 3. Further description of a suitable three-dimensional engineered material is provided in U.S. Pat. No. 5,731,062, issued Mar. 24, 1998 to Kim et al. and U.S. patent application Ser. No. 09/306,601, filed May 6, 1999 to Romano et al., the disclosures of which are expressly incorporated by reference herein. Lower cushion 20 further includes a layer of fireguard 32 extending around the perimeter of bottom, intermediate, and top layers of foam 24, 26, 28 and layer of engineered material 30 as shown, for example, in FIG. 2.

Lower cushion 20 also includes a wipable ticking material 34 that covers bottom, intermediate, and top layers of foam 24, 26, 28, layer of engineered material 30, and fireguard 32 as shown for example in FIGS. 2–3. After each use, ticking material 34 is cleaned by a care giver so that it is sanitized for its next use.

Each fastener 36 is preferably a snap and includes an upper portion 38 coupled to ticking material 34 of lower cushion 20 and a lower portion 40 coupled to panel 16. To couple lower cushion 20 to panel 16, a user snaps upper portions 38 of fasteners 36 to lower portions 40 of fasteners 36 as shown, for example, in FIG. 3.

As shown in FIG. 3, upper mattress portion 22 includes an outer wall 42, an inner wall 44, a plurality of baffles 46 that extend between inner and outer walls 42, 44, and a nozzle 47 coupled to outer wall 42. The perimeter of inner wall 44 is welded to outer wall 42 to define a bladder or upper cushion 48. When inflated, bladder 48 provides support for a person positioned on mattress section 12. Bladder 48 is inflated using a source of pressurized air (not shown) coupled to nozzle 47. Bladder 48 may be inflated before or after the insertion of lower cushion 20 into upper mattress portion 22. Top wall 52 includes a series of microvents 59 that permit a predetermined amount of air to leak out of bladder 48 so that bladder 48 is a low air loss bladder. Preferably, top wall 52 includes twelve microvents 59 having a diameter of 0.030 inches when upper mattress portion 22 is inflated to a pressure ranging from 0–18 inches of water.

According to the preferred embodiment, six baffles 46 define seven pockets 49 in bladder 48. According to alternative embodiments, fewer or more baffles are provided to divide the bladder into fewer or more pockets. According to the presently preferred embodiment of the present disclosure, baffles 46 and inner wall 44 are made of a 5 millimeter urethane material.

Outer wall 42 also provides a cover 50 that partially surrounds lower cushion 20 as shown in FIG. 3. Outer wall 42 includes a top wall 52 welded to each baffle 46, a perimeter side wall 54 integral with top wall 52, and a bottom wall 56 integral with side wall 54 as shown, for example, in FIG. 3. Top, side, and bottom walls 52, 54, 56 define an interior region 60 of cover 50 in which lower cushion 28 is positioned during use of mattress section 12. Bladder 48 also includes top wall 52 and a bottom wall 58 welded to top wall 52. Thus, bladder 48 and cover 50 share common top wall 52.

Side wall 54 includes first, second, third, and fourth panels 62, 64, 66, 68. First and third panels 62, 66 are integral with top wall 52 and bottom wall 56, as shown for example in FIG. 3. Second and fourth panels 64, 68 are welded to top wall 52 and are also integral with bottom wall 56. Second and fourth panels 64, 68 also weld to first and third panels 62, 66 to define corners 69 of sidewall 54.

Bottom wall 56 of cover 50 includes first, second, third, and fourth flaps 70, 72, 74, 76. First and third flaps 70, 74 are integral with respective first and third panels 62, 66 as shown in FIG. 3. Second and fourth flaps 72, 76 are integral with respective second and fourth panels 64, 68. Second and fourth flaps 72, 76 are welded to first and second flaps 70, 74 to define corner seams 77 of bottom wall 56. Thus, in the illustrated embodiment, first flap 70, first panel 62, top wall 52, third panel 66, and third flap 74 are formed from a uniform piece of material. According to the presently preferred embodiment, this material is made of a non-woven plastics material having a cotton-like feel sold under the brand name Securon.

First, second, third, and fourth flaps 70, 72, 74, 76 each include an edge 78 defining an opening 80 in bottom wall 46. Fasteners 36 are spaced apart from edges 78 and extend through opening 80 to couple lower cushion 20 to deck panel 16. A care giver slides lower cushion 20 through opening 80 to insert lower cushion 20 into upper mattress portion 22. Similarly, lower cushion 20 is removed from upper mattress portion 22 by pulling lower cushion through opening 80. Thus, upper mattress portion 22 provides a combination inflatable cushion and cover that provides support to a patient positioned thereon and protection to lower cushion 20 and is disposable and lower cushion 20 provides a reusable patient support.

Although the invention has been described in detail with reference to preferred embodiments, variations and modifications exist within the scope and spirit of the invention as described and defined in the following claims.

What is claimed is:

1. A mattress for use on a deck of a bed, the mattress comprising:

a bladder including an outer wall defining an interior region, a layer of resilient material, and a layer of three dimensional engineered material positioned between the layer of resilient material and the air bladder, the layer of three dimensional engineered material including a fiber network formed to include a plurality of resilient hollow projections.

2. The mattress of claim 1, wherein the projections are conical.

3. A method for positioning and replacing a mattress on a deck of a bed, the method comprising the step of providing a mattress having a reusable cushion and substantially identical first and second disposable mattress portions, each of the first and second disposable mattress portions including a cover, coupling the first disposable mattress portion to the reusable cushion while the second disposable mattress portion is spaced apart from the reusable cushion, the coupling including wrapping a portion of the first disposable mattress portion around and beneath the reusable cushion, replacing the first disposable mattress portion with the second disposable mattress portion, and disposing of the first disposable mattress portion.

4. The method of claim 3, wherein the coupling step includes wrapping a portion of the first disposable mattress portion around the reusable cushion.

5. The method of claim 4, wherein the replacing step including removing the reusable cushion from with an interior region of the first disposable mattress portion and inserting the reusable cushion into an interior region of the second disposable mattress portion.

6. A method for positioning and replacing a mattress on a deck of a bed, the method comprising the step of providing a mattress having a reusable cushion and substantially identical first and second disposable mattress portions, coupling the first disposable mattress portion to the reusable cushion while the second disposable mattress portion is spaced apart from the reusable cushion, replacing the first disposable mattress portion with the second disposable mattress portion, disposing of the first disposable mattress portion, and coupling the reusable cushion to the deck of the bed.

7. A method for positioning and replacing a mattress on a deck of a bed, the method comprising the step of providing a mattress having a reusable cushion and substantially identical first and second disposable mattress portions, the first and second disposable mattress portions each comprising a cover including a side wall defining an interior region of the cover, coupling the first disposable mattress portion to the reusable cushion while the second disposable mattress portion is spaced apart from the reusable cushion, replacing the first disposable mattress portion with the second disposable mattress portion, and disposing of the first disposable mattress portion.

8. The method of claim 7, wherein the first and second disposable mattress portions include an outer wall defining an interior region configured to receive pressurized fluid.

9. The method of claim 8, wherein the outer wall of each of the first and second mattress portions includes a top wall and a bottom wall and the bottom wall cooperates with the side wall of the cover to define the interior region of the cover.

10. The method of claim 8, wherein each of the first and second disposable mattress portions includes a baffle extending between the top and bottom walls to define a plurality of pockets within the interior region of each of the first and second disposable mattress portions.

11. The method of claim 8, wherein the top wall of the outer wall of each of the first and second disposable mattress portions defines a patient support surface.

12. The method of claim 7, wherein the cover further includes a bottom wall coupled to the side wall and the reusable cushion is positioned between the bottom wall of the cover and one of the disposable mattresses.

13. The method of claim 12, wherein the bottom wall of the cover is integral with the side wall.

14. The method of claim 7, wherein the reusable cushion is Positioned between one of the disposable mattresses and the deck of the bed.

15. The method of claim 7, wherein the reusable cushion includes a layer of resilient material.

* * * * *